United States Patent [19]

Kajlich

[11] 4,048,677

[45] Sept. 20, 1977

[54] TURBULENCE INHIBITORS

[76] Inventor: Anton J. Kajlich, 2028 N.W. 58th St., Seattle, Wash. 98107

[21] Appl. No.: 582,896

[22] Filed: June 2, 1975

[51] Int. Cl.[2] ..... E04H 3/16; E04H 3/18; B63B 21/52

[52] U.S. Cl. ..... 4/172; 9/8 R

[58] Field of Search ..... 4/172, 172.15, 172.16, 4/172.17; 61/5; 9/8 R; 114/.5 R

[56] References Cited

U.S. PATENT DOCUMENTS

| | | | |
|---|---|---|---|
| 3,074,083 | 1/1963 | Schirmer | 9/8 R |
| 3,304,560 | 2/1967 | Kiefer | 4/172.15 |
| 3,540,063 | 11/1970 | Stanwood | 4/172 |
| 3,755,829 | 9/1973 | Walklet | 4/172 |
| 3,757,370 | 9/1973 | Seno et al. | 9/8 R |
| 3,786,521 | 1/1974 | Walklet | 4/172.15 |
| 3,793,657 | 2/1974 | Klaas | 9/8 R |
| 3,886,602 | 6/1975 | Stanwood | 4/172 |

*Primary Examiner*—Richard E. Aegerter
*Assistant Examiner*—Stuart S. Levy
*Attorney, Agent, or Firm*—Robert B. Hughes

[57] ABSTRACT

A device, being one of a multiple of identical units adapted to be strung on a lane-separating cable for swimming pools, and being formed with deflecting and turbulence-inhibiting baffles or vanes, enclosed within an annular band or shell.

10 Claims, 5 Drawing Figures

TURBULENCE INHIBITORS

BACKGROUND OF THE INVENTION

This invention relates to swimming pool equipment and more particularly to means, used in conjunction with lane-separating cables, for the purpose of dampening wave action and otherwise inhibiting turbulence set up by the activities of persons using the aquatic facilities to which the utilization of such equipment pertains.

It is an established fact that the activities of a swimmer in one lane can cause conditions which are definitely detrimental to persons performing in adjacent lanes. This is sepecially a matter of considerable concern during contests, where the wake set up by a contender who may be slightly in the lead can cause divergent, backwardly flowing current action.

Various methods have been proposed to eliminate the aforesaid conditions, typical examples being disclosed by U.S. Pat. Nos. 3,304,560 and 3,498,246. While all such devices are successful to a greater or lesser degree, in controlling turbulent conditions, they present problems in handling and storage. By its very nature, equipment of this type is bulky, unwieldy and extremely difficult to cope with at installation or remvoal.

SUMMARY OF THE INVENTION

It is the principal object of the present invention to provide a means of controlling turbulence by a combination of current directing and dissipating methods.

Another object of the invention is the provision of a turbulence-controlling device which will function, mainly within the interior thereof, by providing relatively unrestricted passage of wave action thereinto.

A further object of the invention is the provision of equipment as described which can be easily handled, and which can be stored in a minimum of space.

These and other objects of the invention will become apparent during the course of the following description, taken in connection with the accompanying drawing forming a part hereof.

DESCRIPTION OF THE PREFERRED EMBODIMENT

Figure 1:
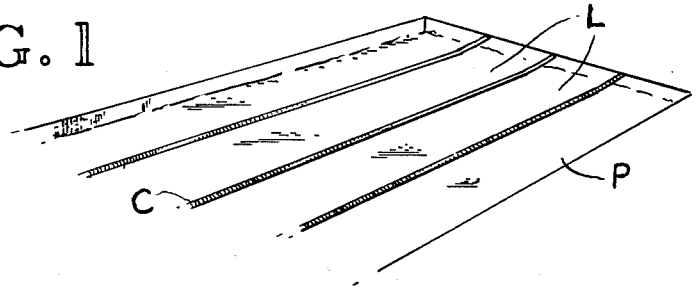
FIG. 1 is a fragmentary perspective outline of a swimming pool divided into lanes.

Referring to the drawing in detail, a swimming pool P, is separated into individual lanes L by cables C. These cables, which extend the length of the pool, are secured at the ends thereof, and are maintained in the preferred vertical alignment by means of floats, not shown, which are suitably spaced apart, and which are attached to the cables in any approved manner. Between the individual floats, and the floats and the cabale ends, turbulence-inhibiting devices 10 will be strung in sufficient number to fill the spaces.

The turbulence-inhibitor, in its preferred embodiment, is a single unit of integral construction, made of a suitable plastic material, by the injection mold process.

It consists essentially of a central hub or sleeve 11, an outer, annular band or shell 12, concentric therewith, and a plurality of flat, relatively thin deflecting vanes or baffles 13, extending radially from the hub 11, and being attached at their remote ends to the inner surface of the band 12. The width of the band 12 is considerably less than the length of the hub 11.

Figure 2:
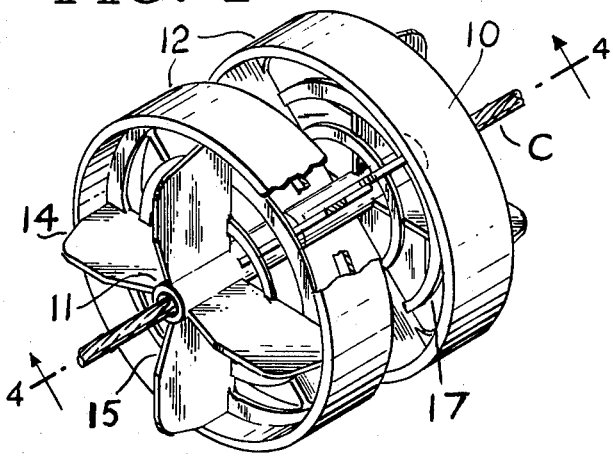
FIG. 2 is a perspective view of a pair of the devices in place on a section of cable.
Figure 3:
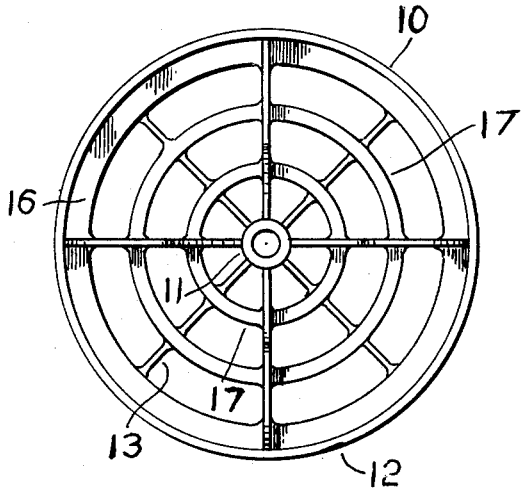
FIG. 3 is a typical end elevation of one of the units.

As can be clearly seen on FIG. 2, the vanes 13 are arranged in tow sets, each of which four individual vanes, equally spaces around the hub 11. Each set is so formed and positioned within the shell 12 that their inner radial edges are coplanar and coincident with a median, transverse line passing through the hub 11, and the band 12. At their outer edges, which are generally perpendicular to the axis of the hub 11, the vanes extend slightly beyond the respective ends thereof, and, of course, to a greater degree beyond the edges of the band 12.

Figure 4:
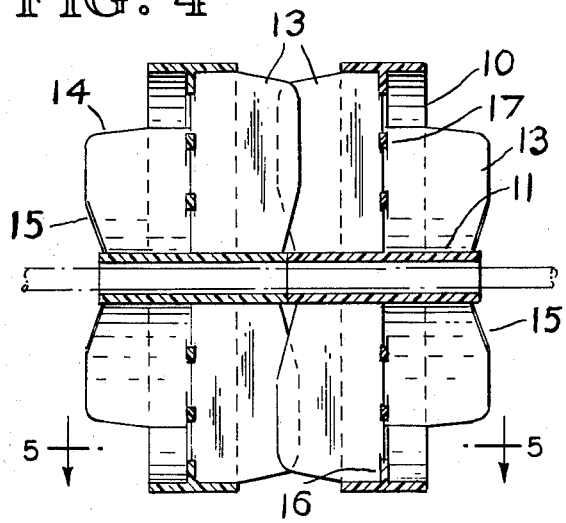
FIG. 4 is a longitudinal median section taken on line 4—4 of FIG. 2.
Figure 5:
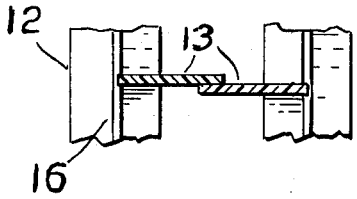
FIG. 5 is a fragmentary section taken on line 5—5 of FIG. 4.

Extending outwardly from the edges of the band 12, each vane is slightly tapered at its remote corner as indicated at 14, and on its vertical outer edge, it is beveled back, as shown at 15, to a point slightly within the respective ends of the hub 11. As viewed from the section shown on FIG. 4, the construction of the device, up to the point of this description, and also hereafter, presents a unit which is symmetrical about a transverse median line, with one exception. The vanes 13 on one side of the unit are in longitudinal alignment with the spaces intermediate the vanes on the other side.

There is a twofold reason for this particular vane alignment and configuration. First, wave or currents of water which enter the spaces between the bands of adjacent units are not confronted with a continuous baffle which could, in effect, cause rebound and a neutralizing action of any water dispersing means. The arrangement of the offset alignment of the vanes definitely causes a dispersion of water which may be deflected longitudinally while preventing lateral passage therethrough be the overlapping from one unit to the next.

This dispersion action is augmented by the provision of an inwardly projecting flange 16 formed on the interior surface of the band 12, and a series of arcuate ribs 17 which connect the vanes at their inner edges. The arrangement and size of the said flange and ribs is such that ample space is provided therebetween for the free flow of water.

Secondly, equipment of this type, in its assembled condition is extremely unwieldy, and presents serious problems in handling, shipping and storage. With this in mind, the present unit has been devised to alleviate this condition to a significant degree. By reference to FIG. 4 it will be seen that the only parts which are in aligned contiguity are the confronting ends of the hubs 11. At these points the cable C can be deflected a sufficient amount to allow a transverse angular relationship of adjacent units to a point whrer contact between the edges of the adjacent bands takes place. By this arrangement, cables of considerable lengths can be coiled and stacked in a minimum of space.

From the foregoing it will be apparent that I have provided a design of equipment which represents a real advance over that presently in use, and while I have described and illustrated a preferred embodiment of my invention, it should be understood that moditications may be made within the spirit and intent of Title 35, United States Code, Section 112, Par. 3.

I claim:

1. A turbulence inhibiting device adapted to be assembled as one of a plurality of such devices in axial alignment with one another to provide a turbulence inhibiting lane, said device comprising:

a. a central hub having a longitudinal axis b. an annular band postioned generally concentrically around said hub with ends of said hub extending axially beyond circumferential edge portions of said band, c. a plurality of generally planer vanes extending radially from said hub to said band, the plane of each of said vanes being substantially aligned with said longitudinal axis, said vanes projecting axially beyond said hub so as to be able to engage vanes of an adjacent device and limit relative rotation between such adjacent devices, d. said hub, band and vanes defining substantially open space within said band for substantially free flow of water therethrough, whereby with a plurality of such devices arranged in axial alignment, adjacent bands provide openings therebetween for flow of water through said openings, said vanes and said bands define axially aligned passageway means for flow of water axially within the aligned devices, and vanes of proximate devices overlap one another so that with proximate devices rotating relative to one another, engagement of proximate vanes limits such relative rotation to arcuate increments of travel between proximate vanes.

2. The deivce as recited in claim 1, wherein the vanes of said device are arranged in two sets, spaced axially from one another and off-set angularly from one another, whrerby said longitudinal passageway means is partitioned by axially spaced and angularly off-set vanes.

3. The device as recited in claim 1, wherein said device has a centerthrough opening to receive cable means to which the device is adapted to be mounted.

4. The device as recited in claim 1, wherein the outer edges of the projecting portions of said vanes are in converging relationship toward the longitudinal axis of the device.

5. The device as recited in claim 4, wherein the radially outward edges of said vanes are bevelled back to a point within the ends of said hub.

6. A turbulence inhibiting lane comprising a plurality of individual turbulence inhibiting devices assembled in axial alignment with respect to each other, each of said devices comprising:

a. a central hub having a longitudinal axis b. an angular band positioned generally concentrically around said hub with ends of each hub extending axially beyond circumferential edge portions of said band, c. plurality of generally planer vanes extending radially from said hub to said band, the plane of each of said vanes being substantially aligned with said longitudinal axis, said vanes projecting axially beyond said hub so as to engage vanes of an adjacent device and limit relative rotation between such adjacent devices, d. said hub, band and vanes of each device defining substantially open space within the band of each hub for substantially free flow of water therethrough, whereby adjacent bands provide openings therebetween for flow of water through said openings, said vanes and said bands define axially aligned passageway means for flow of water axially through the devices, and vanes of proximate devices overlap one another so that with proximate devices rotating relative to one another engagement of proximate vanes limits such relative rotation of arcuate increments of travel between proximate vanes.

7. The lane as recited in claim 6, wherein the vanes of each of said devices are arranged in two sets, spaced axially from one another and off-set angularly from one another, whereby said longitudinal passageway means is partitioned by axially spaced and angularly off-set vanes.

8. The lane as recited in claim 6, wherein said device has a centerthrough opening to receive cable means to which the device is adapted to be mounted.

9. The lane as recited in claim 6, wherein the outer edges of the projecting portions of said vanes are in converging relationship toward the longitudinal axis of the device.

10. The lane as recited in claim 9, wherein the transverse outer edges of said vanes are bevelled back to a point within the ends of said hub.

* * * * *